US005931122A

United States Patent [19]

Okabe et al.

[11] Patent Number: 5,931,122

[45] Date of Patent: Aug. 3, 1999

[54] VISCOUS FLUID TYPE HEAT GENERATOR WITH MEANS FOR IMPEDING DEGRADATION OF THE VISCOUS FLUID

[75] Inventors: Takanori Okabe; Takashi Ban, both of Kariya, Japan

[73] Assignee: Kabushikki Kaisha Jidoshokki Seisakusho, Kariya, Japan

[21] Appl. No.: 08/968,348

[22] Filed: Nov. 12, 1997

[30] Foreign Application Priority Data

Nov. 12, 1996 [JP] Japan ..... 8-300147

[51] Int. Cl.[6] ..... F22B 3/06

[52] U.S. Cl. ..... 122/26; 126/247

[58] Field of Search ..... 122/26; 126/247; 237/12.3 R, 12.3 B

[56] References Cited

U.S. PATENT DOCUMENTS 4,312,322 1/1982 Freihage .
4,974,778 12/1990 Bertling .
5,573,184 11/1996 Martin .

FOREIGN PATENT DOCUMENTS 2246823 2/1990 Japan .

*Primary Examiner*—Teresa Walberg
*Assistant Examiner*—Jiping Lu
*Attorney, Agent, or Firm*—Burgess, Ryan & Wayne

[57] ABSTRACT

A viscous fluid type heat generator including a housing assembly in which a heat generating chamber confining therein a heat generative viscous fluid to which a shearing action is applied by a disc-like rotor element rotated by a drive shaft, and having inner wall surfaces confronting outer surfaces of the disc-like rotor element, the inner wall surfaces of the heat generating chamber and the outer faces of the rotor element defining small fluid holding and/or heat generating gaps in which the viscous fluid is filled so that it is forced to make a circulatory movement within the heat generating chamber by the rotating rotor element via at least one through-passage which is arranged to pierce the outer surfaces of the disc-like rotor element, and have either an obliquely extending through-bore of which the center line extends along the rotating direction of the rotor element, or an axially linear through-bore having a sloping recess formed in at least one of the opposite bore ends to obliquely extend in a direction along the rotating direction of the rotor element, and an acute edge portion able to increase the shearing force applied to the viscous fluid.

16 Claims, 5 Drawing Sheets

VISCOUS FLUID TYPE HEAT GENERATOR WITH MEANS FOR IMPEDING DEGRADATION OF THE VISCOUS FLUID

BACKGROUND OF THE INVENTION

1. Field of the Invention

The present invention relates to a viscous fluid type heat generator not exclusively but particularly suitable for being incorporated in an automobile heating system to heat the automobile passenger compartment. The viscous fluid type heat generator in which a viscous fluid is subjected to a shearing action to generate heat that is in turn transmitted to a circulating heat-transfer or heat-exchange fluid in a heat receiving chamber, and is carried by the heat-transfer fluid to a desired heated area, such as a passenger compartment in an automobile. More particularly, the present invention relates to a viscous fluid type heat generator adapted for being used as a supplementary heat source incorporated in an automobile heating system and having such a construction thereof able to regulate heat generation in response to either a change in an environment in which the viscous fluid type heat generator is used or a change in an operating condition of the heat generator, i.e., an operating speed of the viscous fluid type heat generator.

2. Description of the Related Art

Japanese Unexamined Patent Publication (Kokai) No. 2-246823 (JP-A-2-246823) discloses a typical automobile heating system in which a viscous fluid type heat generator, able to generate heat by using a viscous fluid generating heat when it is subjected to shearing action, is incorporated. The viscous fluid type heat generator disclosed in JP-A-2-246823 includes a pair of mutually opposing front and rear housings tightly secured together by appropriate tightening elements, such as through bolts, to define an inner heat generating chamber and a heat receiving chamber arranged adjacently to the heat generating chamber but separated by a partition wall through which the heat is exchanged between the viscous fluid in the heat generating chamber and the water in the heat receiving chamber. The heat generating chamber is formed as a cylindrical chamber having front and rear inner walls.

The heat exchanging water is introduced into the heat receiving chamber through a water inlet port and delivered from the heat receiving chamber toward an external heating system, so that the heat exchanging water is constantly circulated through the heat generator and the external heating system.

A drive shaft is supported in the front housing via anti-friction bearing so as to rotate about a substantially horizontal axis of rotation, and to support thereon a rotor element in such a manner that the rotor element is rotated with the drive shaft within the heat generating chamber. The rotor element has outer surfaces which are face-to-face with the front and rear inner walls of the heat generating chamber and form labyrinth grooves therebetween, and a viscous fluid is supplied into the heat generating chamber so as to fill the labyrinth grooves between the outer surfaces of the rotor element and the wall faces of the heating chamber.

When the drive shaft of the viscous fluid type heat generator incorporated in the automobile heating system is driven by an automobile engine, the rotor element is also rotated within the heat generating chamber so as to apply a shearing action to the viscous fluid held between the wall surfaces of the heat generating chamber and the outer surfaces of the rotor element. Thus, the viscous fluid which typically consists of a polymer material, for example, a silicone oil having a chain molecular structure exhibiting a high viscosity, generates heat due to the shearing action applied thereto. The heat is transmitted from the viscous fluid to the heat exchanging water circulating through the heat receiving chamber. The heat exchanging water carries the heat to the heating circuit of the automobile heating system, and permits the heating circuit to heat or warm the objective heated area of the automobile such as the passenger compartment.

In the above-described viscous fluid type heat generator according to the prior art, there are provided front and rear gaps in the heat generating chamber, formed between the wall surface of the front wall of the heat generating chamber and the front outer surface of the rotor element, and the wall surface of the rear wall of the heat generating chamber and the rear outer surface of the rotor element. Only a small annular gap provided between the outer circumference of the rotor element and a corresponding annular inner wall surface of the heat generating chamber permits the front and rear gaps to fluidly communicate with one another. Thus, the viscous fluid cannot easily move from the front gap to the rear gap and vice versa within the heat generating chamber. Accordingly, a specified portion of the viscous fluid within the heat generating chamber must be constantly subjected to the shearing action by the rotating rotor element to generate heat, and therefore, the physical property of the specified portion of the viscous fluid is degraded for a short period of time with respect to the overall operation time of the heat generator. The degradation in the physical property of the viscous fluid results in a reduction in the heat generating performance of the viscous fluid during the operation of the heat generator.

SUMMARY OF THE INVENTION

Therefore, an object of the present invention is to provide a viscous fluid type heat generator provided with a heat generating chamber accommodating therein a circulating means for activating a circulatory movement of a viscous fluid within the heat generating chamber to thereby impede a degradation of the heat generating performance of the viscous fluid relative to a long life of operation of the heater.

In accordance with the present invention, there is provided a viscous fluid type heat generator fluid-frictionally generating a heat by the application of a shearing force to a viscous fluid, comprising:

a housing assembly;

a fluid-tight heat generating chamber defined in the housing assembly and receiving the viscous fluid filled therein, the fluid-tight heat generating chamber having inner wall surfaces thereof;

a heat receiving chamber arranged adjacent to the fluid-tight heat generating chamber and permitting a heat exchanging fluid to circulate therethrough to thereby receive heat from the fluid-tight heat generating chamber;

a drive shaft supported by the housing assembly to be rotatable about an axis of rotation thereof; and a rotor element arranged in the heat generating chamber to be rotationally driven by the drive shaft for rotation about an axis of rotation thereof relative to the heat generating chamber, wherein the rotor element is provided with outer surfaces confronting the inner wall surfaces of the fluid-tight heat generating chamber to define predetermined gaps on both sides of the outer surfaces thereof, the rotor element being further provided with at least one through-passage bored through the outer surfaces thereof to have a fluid guide permitting the viscous fluid within the heat generating chamber to move through the through-passage in response to the rotation of the rotor element.

Preferably, the outer surfaces of the rotor element are arranged to extend substantially perpendicularly to the axis of rotation of the rotor element, and the through-passage of the rotor element is formed as a through-bore having a center line obliquely extending from one of the outer surfaces to the other thereof and an oblique bore wall functioning as the fluid guide, the center line of said through-bore being arranged to extend along the rotating direction of the rotor element.

Further preferably, the rotor element is provided with a plurality of through-passages arranged circumferentially and equidistantly around the axis of rotation of the rotor element, each of the plurality of through-passages being formed as the through-bore obliquely piercing the outer surfaces of the rotor element.

Further, the through-passage of the rotor element is arranged in at least one of radially inner and outer regions of the rotor element with respect to the axis of rotation thereof.

Alternatively, the through-passage of the rotor element may include at least one through-bore pierced through the outer surfaces of the rotor element, and at least one sloping recess formed in one of opposite ends of the through-bore so as to extend in one of two directions corresponding to the rotating and counter-rotating directions of the rotor element.

Preferably, the through-passage include a pair of sloping recesses formed in the opposite ends of the through-bore of the rotor element, one of the pair of sloping recesses extending in the direction corresponding to the rotating direction of the rotor element, and the other of the pair of sloping recesses extending in the direction corresponding to the counter-rotating direction of the rotor element.

The through-bore and the sloping recess of the through-passage of the rotor element are preferably arranged in at least one of radially inner and outer regions with respect to the axis of rotation of the rotor element.

The opposite ends of the through-bore should not be rounded and should have an acute edge to apply a resistance to the movement of the viscous fluid, during the rotation of the rotor element within the heat generating chamber. The application of the resistance to the movement of the viscous fluid results in applying a stronger shearing force to the viscous fluid to thereby increase heat generation by the viscous fluid.

Preferably, the viscous fluid type heat generator is further provided with a fluid storing chamber for storing a given amount of viscous fluid, which communicates with the heat generating chamber via a fluid withdrawing passage through which the viscous fluid is withdrawn from the heat generating chamber to the fluid storing chamber and via a fluid supplying passage through which the viscous fluid is supplied from the fluid storing chamber to the heat generating chamber.

The predetermined gaps on both sides of the outer surfaces of the rotor element are communicated with one another via an annular gap provided between the outer circumference of the rotor element and a confronting annular inner wall surface of the heat generating chamber, so that the viscous fluid may be permitted to perform a circulatory movement from the fluid supplying chamber through the predetermined gaps on both sides of the rotor element.

In accordance with another aspect of the present invention, there is provided a viscous fluid type heat generator fluid-frictionally generating a heat by the application of a shearing force to a viscous fluid, comprising:

a housing assembly;

a fluid-tight heat generating chamber defined in the housing assembly and receiving the viscous fluid filled therein, the fluid-tight heat generating chamber having inner wall surfaces thereof;

a heat receiving chamber arranged adjacent to the fluid-tight heat generating chamber and permitting a heat exchanging fluid to circulate therethrough to thereby receive heat from the fluid-tight heat generating chamber;

a drive shaft supported by the housing assembly to be rotatable about an axis of rotation thereof; and a rotor element arranged in the heat generating chamber to be rotationally driven by the drive shaft for rotation about an axis of rotation thereof relative to the heat generating chamber, wherein the rotor element is provided with axially front and rear outer surfaces confronting the inner wall surfaces of the heat generating chamber to define predetermined gaps therebetween, the rotor element being further provided with at least one through-passage bored through the front and rear outer surfaces of the rotor element, the through-passage extending obliquely with respect to the front and rear outer surfaces of the rotor element and having a central line in a direction corresponding to the rotating direction of the rotor element to permit the viscous fluid within the heat generating chamber to move through the through-passage in response to the rotation of the rotor element.

Preferably, the oblique through-passage of the rotor element is formed to descend from the rear outer surface toward the front outer surface of the rotor element, with respect to the rotating direction of the rotor element, so that the viscous fluid is moved from the predetermined fluid holding gap between the front outer surface of the rotor element and the inner wall surface of the heat generating chamber toward the predetermined fluid holding gap between the rear outer surface of the rotor element and the inner wall surface of the heat generating chamber in response to the rotation of the rotor element.

Alternatively, the oblique through-passage of the rotor element is formed to descend from the front outer surface toward the rear outer surface of the rotor element, with respect to the rotating direction of the rotor element, so that the viscous fluid is moved from the predetermined fluid holding gap between the rear outer surface of the rotor element and the inner wall surface of the heat generating chamber toward the predetermined fluid holding gap between the front outer surface of the rotor element and the inner wall surface of the heat generating chamber in response to the rotation of the rotor element.

Preferably, the viscous fluid type heat generator is further provided with a fluid storing chamber for storing a given amount of viscous fluid, which communicates with the heat generating chamber via a fluid withdrawing passage through which the viscous fluid is withdrawn from the heat generating chamber to the fluid storing chamber and via a fluid supplying passage through which the viscous fluid is supplied from the fluid storing chamber to the heat generating chamber.

The predetermined gaps on both sides of the outer surfaces of the rotor element are communicated with one another via an annular gap provided between an outer circumference of the rotor element and a confronting cylindrical inner wall surface of the heat generating chamber, so that the viscous fluid may be permitted to make a circulatory movement from the fluid storing chamber through the predetermined fluid holding gaps on both sided of the rotor element.

In accordance with a further aspect of the present invention, there is provided a viscous fluid type heat generator fluid-frictionally generating a heat by the application of a shearing force to a viscous fluid, comprising:

a housing assembly;

a fluid-tight heat generating chamber defined in the housing assembly and receiving the viscous fluid filled therein, the fluid-tight heat generating chamber having inner wall surfaces thereof;

a heat receiving chamber arranged adjacent to the fluid-tight heat generating chamber and permitting a heat exchanging fluid to circulate therethrough to thereby receive heat from the fluid-tight heat generating chamber;

a drive shaft supported by the housing assembly to be rotatable about an axis of rotation thereof; and a rotor element arranged in the heat generating chamber to be rotationally driven by the drive shaft for rotation about an axis of rotation thereof relative to the heat generating chamber, wherein the rotor element is provided with axially front and rear outer surfaces confronting the inner wall surfaces of the heat generating chamber to define predetermined gaps therebetween, the rotor element being further provided with at least one through-passage bored through the front and rear outer surfaces of the rotor element, the through-passage including a through-bore piercing through the front and rear outer surfaces of the rotor element and having opposite ends thereof, and at least one sloping recess formed in one of the opposite ends of the through-bore to extend in a direction corresponding to one of the rotating and counter-rotating directions of the rotor element, the sloping recess permitting the viscous fluid to move between the predetermined gaps via the through-bore of the rotor element.

Preferably, the sloping recess of the through-passage of the rotor element is arranged in the front outer surface of the rotor element, and obliquely extends in a direction corresponding to the rotating direction of the rotor element, so that the viscous fluid is permitted to move from the predetermined gap between the front outer surface of the rotor element and the inner wall surface of the heat generating chamber toward the predetermined gap between the rear outer surface of the rotor element and the inner wall surface of the heat generating chamber.

Alternatively, the sloping recess of the through-passage of the rotor element may be arranged in the rear outer surface of the rotor element, and obliquely extends in a direction corresponding to the rotating direction of the rotor element, so that the viscous fluid is permitted to move from the predetermined gap between the rear outer surface of the rotor element and the inner wall surface of the heat generating chamber toward the predetermined gap between the front outer surface of the rotor element and the inner wall surface of the heat generating chamber.

Further alternatively, the sloping recess of the through-passage of the rotor element may be arranged in the front outer surface of the rotor element, and obliquely extends in a direction corresponding to the counter-rotating direction of the rotor element, so that the viscous fluid is permitted to move from the predetermined gap between the rear outer surface of the rotor element and the inner wall surface of the heat generating chamber toward the predetermined gap between the front outer surface of the rotor element and the inner wall surface of the heat generating chamber via the through-bore.

Still further, the sloping recess of the through-passage of the rotor element may be arranged in the rear outer surface of the rotor element, and obliquely extends in a direction corresponding to the counter-rotating direction of the rotor element, so that the viscous fluid is permitted to move from the predetermined gap between the front outer surface of the rotor element and the inner wall surface of the heat generating chamber toward the predetermined gap between the rear outer surface of the rotor element and the inner wall surface of the heat generating chamber via the through-bore.

Preferably, the above-mentioned viscous fluid type heat generator is further provided with a fluid storing chamber for storing a given amount of viscous fluid, which communicates with the heat generating chamber via a fluid withdrawing passage through which the viscous fluid is withdrawn from the heat generating chamber to the fluid storing chamber and via a fluid supplying passage through which the viscous fluid is supplied from the fluid storing chamber to the heat generating chamber.

The predetermined gaps on both sides of the outer surfaces of the rotor element are communicated with one another via an annular gap provided between the outer circumference of the rotor element and a confronting cylindrical inner wall surface of the heat generating chamber, so that the viscous fluid may be permitted to make a circulatory movement from the fluid supplying chamber through the predetermined gaps on both sides of the rotor element.

BRIEF DESCRIPTION OF THE DRAWINGS

The above and other objects, features, and advantages of the present invention will be made more apparent from the ensuing description of preferred embodiments with reference to the accompanying drawings wherein.

DESCRIPTION OF THE PREFERRED EMBODIMENTS

Figure 1:
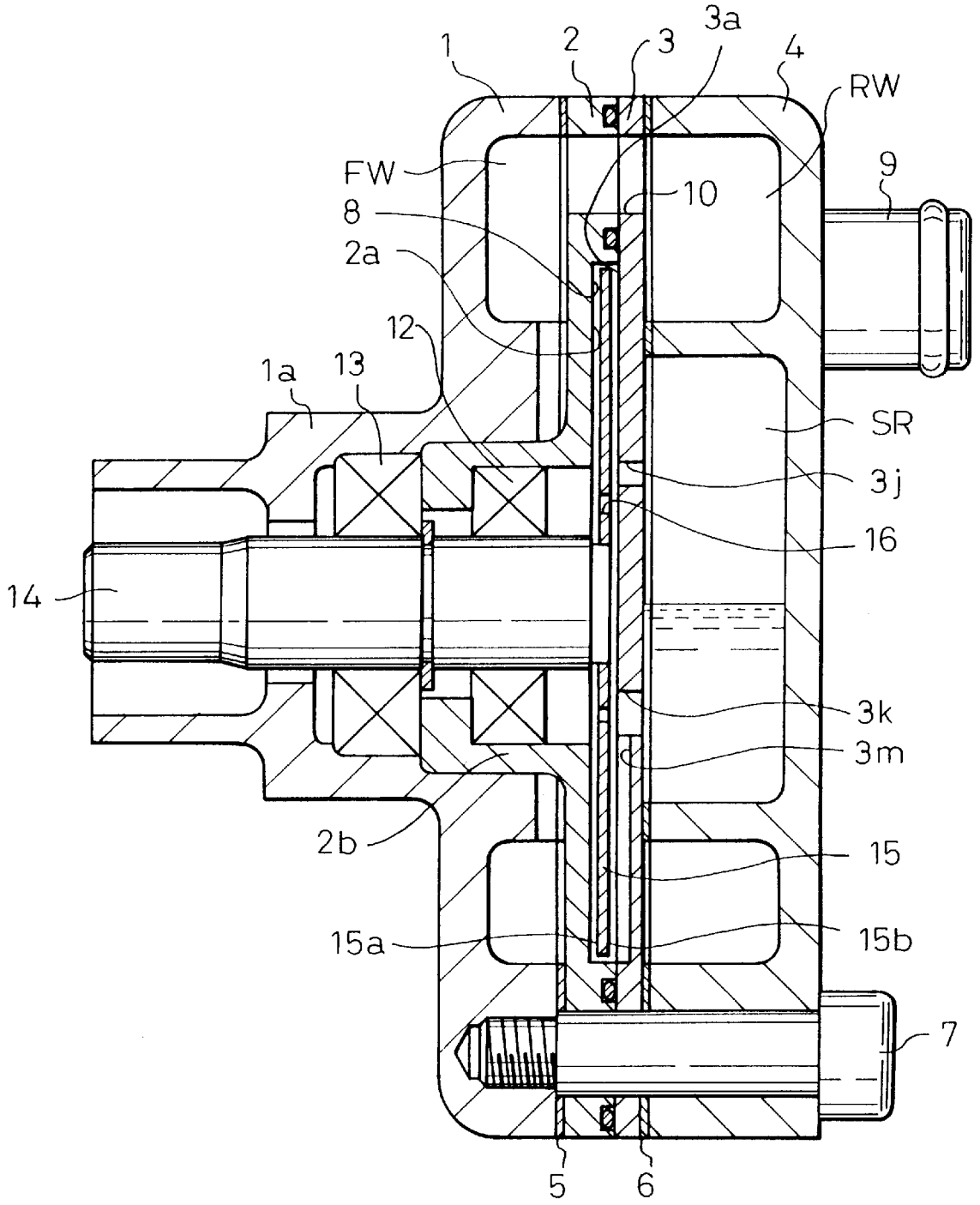
FIG. 1 is a cross-sectional view of a viscous fluid type heat generator in which one of rotor elements according to various embodiments of the present invention may be accommodated.

Referring to FIG. 1, a viscous fluid type heat generator includes a front housing body 1, a front plate element 2, a rear plate element 3, and a rear housing body 4 which are axially combined together by a plurality of screw bolts 7, and gaskets 5 and 6 are interposed between the front housing body 1 and the front plate element 2, and between the rear plate element 3 and the rear housing body 4, respectively, to define a hermetically sealed housing assembly. The housing assembly has a front housing unit consisting of the front housing body 1 and the front plate element 2, and a rear housing unit consisting of the rear plate element 3 and the rear housing body 4. The front plate element 2 of the front housing unit has opposite front and rear end faces, and is provided with a recess formed in the rear end to have a circular inner wall surface 2*a* which axially confronts a front circular end face 3*a* of the rear plate element 3 of the rear housing unit. The inner wall surface 2*a* of the front plate element 2 and the inner end face 3*a* of the rear plate element 3 define a cylindrical closed cavity therebetween formed as a heat generating chamber 8. Thus, the inner wall surface 2*a* of the front plate element 2 and the front end face 3*a* of the rear plate element 3 form axially opposing inner wall surfaces of the heat generating chamber 8.

An inner wall of the front housing body 1 and a front end face of the front plate element 2 define therebetween a front heat receiving chamber FW which is arranged adjacent to a front portion of the heat generating chamber 8, and a rear end face of the rear plate element 3 and an inner wall surface of the rear housing body 4 define therebetween a rear heat receiving chamber RW which is arranged adjacent to a rear portion of the heat generating chamber 8.

The rear housing body 4 is provided with an inlet port 9 and an outlet port (not shown) formed in a peripheral portion of the outer face thereof. The inlet port 9 and the outlet port are fluidly connected to the rear heat receiving chamber RW. The inlet port 9 is provided for introducing heat exchanging liquid into the front and rear heat receiving chambers FW and RW, and the outlet port is provided for delivering the heat exchanging liquid from the heat receiving chambers FW and RW toward the external heating system.

The front and rear plate elements 2 and 3 are provided with a plurality of through-bores 10 arranged equiangularly in respective outer peripheral portions of these plate elements 2 and 3. Each of the through-bores 10 is positioned between the two neighboring screw bolts 7, and forms a fluid passage to provide a fluid connection between the front and rear heat receiving chambers FW and RW.

The front plate element 2 is provided with a boss 2*b* at a central portion thereof for housing a shaft sealing device 12 therein. The shaft sealing device 12 is arranged adjacent to the heat generating chamber 8.

Figure 2:
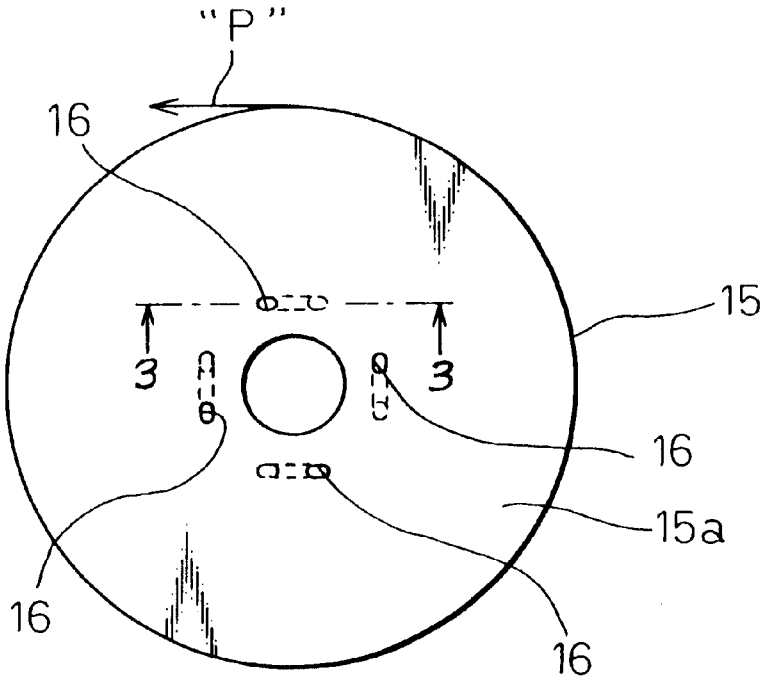
FIG. 2 is a front view of a rotor element according to a first embodiment of the present invention, suitable for being accommodated in the viscous fluid type heat generator of FIG. 1.

The front housing body 1 is provided with an axially outwardly projecting boss portion 1*a* which houses a front bearing device 13 supporting a central portion of a drive shaft 14. Namely, the drive shaft 14 typically arranged in a substantially horizontal state is supported by the bearing device 13 and by the shaft sealing device 12 to be rotatable about an axis of rotation extending horizontally. A rotor element 15 in the shape of a flat disc is mounted and tightly fitted on an axial rear end of the drive shaft 14, and arranged to be rotated by the drive shaft 14 about an axis of rotation thereof within the heat generating chamber 8. The rotor element 15 has axially opposite circular faces 15*a* and 15*b*, and a circumference which form the outer faces of the rotor element 15. The circular faces 15*a* and 15*b* are formed to have a radius far larger than the dimension of the thickness of the rotor element 15, as shown in FIG. 2. The outer diameter of the rotor element 15 is slightly smaller than the inner diameter of the cylindrical heat generating chamber 8 so that a small annular gap is provided between the circumference of the rotor element 15 and a circular inner wall surface of the heat generating chamber 8.

A gap between the outer faces of the rotor element 15 and the inner wall surfaces of the heat generating chamber 8 including the space between the front and rear faces 15*a* and 15*b* of the rotor element 15 and the corresponding inner wall surfaces 2*a* and 3*a* of the heat generating chamber 8 is filled with silicone oil which is a typical viscous fluid having chain molecular structure therein to exhibit a large viscosity. The gap may be referred to as fluid holding and/or heat generating gap in which the silicone oil is held and generates heat by the application of a shearing force thereto.

The drive shaft 14 has an outermost end on which either a pulley (not shown) or a solenoid clutch (not shown) is mounted to operatively connect the heat generator to an outer rotational drive source, typically an automobile engine, via a suitable belt.

As described hereinbefore, the diameter $D_0$ of the rotor element 15 is slightly smaller than the inner diameter of the cylindrical heat generating chamber 8, so that a small annular gap is formed therebetween The clearance between the front end face 15*a* of the rotor element 15 and the corresponding inner wall surface 2*a* of the heat generating chamber 8, and that between the rear end face 15*b* of the rotor element 15 and the corresponding inner wall surface 3*a* of the heat generating chamber 8 are determined to be $0.003 \times r_0$, wherein $r_0$ is the radius of the rotor element, i.e., $r_0$ is equal to ½ $D_0$.

The rotor element 15 may be one of rotor elements according to various embodiments of the present invention described below.

Figure 3:
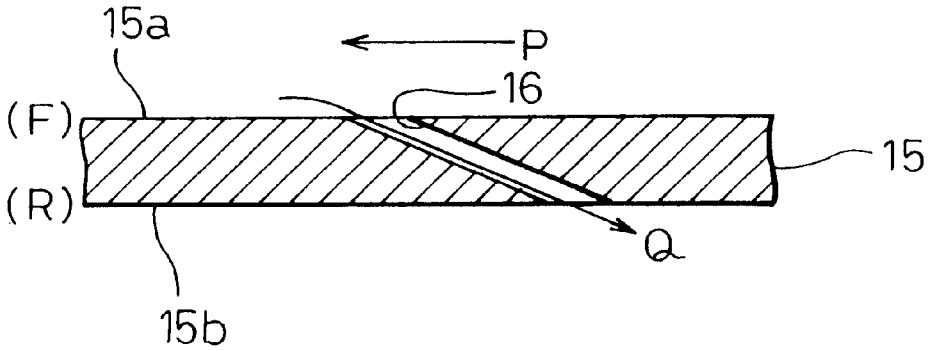
FIG. 3 is a partial and enlarged cross-sectional view of the rotor element, taken along the line A—A of FIG. 2.

As shown in shown FIGS. 2 and 3, the rotor element 15 of the first embodiment is provided with four through-passages 16 arranged in a radially inner region of the rotor element 15 with respect to the axis of rotation thereof. The four through-passages 16 are arranged equiangularly in a circumferential direction and equidistantly in a radial direction with respect to the axis of rotation of the rotor element 15, and each of the four through-passages 16 is formed to extend obliquely downwards from the rear end face 15*b* to the front end face 15*a* of the rotor element 15, as described in more detail hereinbelow.

The radial distance of each of the four through-passages passages 16 with respect to the axis of rotation of the rotor element 15 is desirably determined to be $0.33 \times r_0$. The respective through-passages 16 are provided so as to pierce the entire thickness of the disc-shape rotor element 15, and are formed as linear through-holes having their center lines extending along the rotating direction of the rotor element 15 shown by an arrow "P" in FIGS. 2 and 3 which is tangential to the outer circumference of the rotor element 15. Each of the through-holes has a bore wall functioning as fluid guide permitting the viscous fluid to flow therethrough.

Further, each of the respective though-passages 16 is formed so that the center line thereof obliquely extends from the rear end face 15*b* to the front end face 15*a* of the rotor element 15 in the direction corresponding the rotating direction "P" of the rotor element 15, as clearly shown in FIG. 3.

The radially inner region of the rotor element 15 in which the above-mentioned four obliquely extending through-passages 16 are arranged so as to face a large cylindrical cavity formed adjacent to the shaft sealing device 12 and extending around the inner end portion of the drive shaft 14. However, the large cylindrical cavity is not used for filling the silicone oil therein.

Referring again to FIG. 1, the rear housing body 4 of the viscous fluid type heat generator is internally provided with a cylindrically extending rib which cooperates with the rear end face of the rear plate element 3 to define a centrally arranged fluid storing chamber SR for storing the viscous fluid. The fluid storing chamber SR of the rear housing body 4 fluidly communicates with the heat generating chamber 8 via a through-hole 3*j* formed in the rear plate element 3 at a position above the central portion of the same plate element 3. The through-hole 3*j* is formed as a fluid withdrawal passage through which the viscous fluid may be withdrawn from the heat generating chamber 8 into the fluid storing chamber SR.

The rear plate element 3 is also provided with a larger through-hole 3*k* formed therein at a position below the central portion of the same plate element 3. The larger through-hole 3*k* has a cross-section larger than that of the through-hole 3*j*, and is directly connected to a fluid supply groove 3*m* which radially extends from the end of the through-hole 3*k* toward the bottom of the heat generating chamber 8. The lowermost end of the fluid supply groove 3*m* should preferably be extended so as to reach the bottom of the heat generating chamber 8 beyond the outermost end of the rotor element 15. The larger through-hole 3*k* and the radial fluid supply groove 3*m* are formed as a fluid supply passage through which the viscous fluid may be supplied from the fluid storing chamber SR into the heat generating chamber 8.

When the viscous fluid type heat generator accommodating therein the rotor element 15 of the first embodiment of FIGS. 2 and 3 is incorporated in a heating system of an automobile, and when the drive shaft 14 is driven by an automobile engine via a belt and pulley transmission mechanism, the rotor element 15 is rotated within the heat generating chamber 8. Thus, the silicone oil held between the entire outer surfaces of the rotor element 15 and the inner wall surfaces of the heat generating chamber 8 is subjected to a shearing action by the rotation of the rotor element 15. Therefore, the silicone oil generates heat which is transmitted to a heat exchanging liquid circulating through the front and rear heat receiving chambers FW and RW. Thus, the heat is carried to a heating circuit of the heating system to warm an objective area of the automobile such as a passenger cabin.

With the rotor element 15 of FIGS. 2 and 3, each of the through-passages 16 has one open leading end and the other open trailing end with respect to the rotating direction P of the rotor element 15. The leading end is located in the front end face 15*a* of the rotor element 15, and the trailing end is located in the rear end face 15*b* of the rotor element 15. Therefore, when the rotor element 15 is rotated within the heat generating chamber 8, the viscous fluid held on the front side of the rotor element 15 enters the through-passages 16 via the respective leading open ends thereof, and is delivered from the through-passages 16 via the respective trailing ends toward the gap between the rear end face 15*b* of the rotor element 15 and the inner wall surface 3*a* of the heat generating chamber 8. The movement of the viscous fluid is indicated by an arrow "Q" in FIG. 3. The delivered viscous fluid applies a pressure or a pushing force to the viscous fluid held between the rear end face 15*b* of the rotor element 15 and the inner wall surface of the heat generating chamber 8, and accordingly, a part of the viscous fluid held between the rear end face 15*b* of the rotor element 15 and the inner wall surface 3*a* of the heat generating chamber 8 is moved there toward the gap between the front end face 15*a* of the 15 rotor element 15 and the inner wall surface 2*a* of the heat generating chamber 8 via the small annular gap between the circumference of the rotor element 15 and the cylindrical inner wall surface of the heat generating chamber 8. Namely, there occurs a forced circulatory-movement of the viscous fluid within the heat generating chamber 8 due to the provision of the obliquely extending through-passages 16 of the rotor element 15. It should be noted that according to the first embodiment of the present invention, since each of the four through-passages 16 is arranged to extend along the rotating direction "P" of the rotor element 15, and since the four through-passages 16 are equiangularly arranged around the axis of rotation of the rotor element 15, the viscous fluid can smoothly enter the through-passages 16 via the leading open ends thereof, and smoothly be delivered from the respective through-passages 16 via the trailing open ends thereof. Accordingly, the circulatory movement of the viscous fluid through the gaps between the outer faces of the rotor element 15 and the inner wall surfaces of the heat generating chamber 8 can be promoted to prevent the viscous fluid within the heat generating chamber 8 from stagnating. Further, since the four obliquely extending through-passages 16 are arranged in the inner region of the rotor element 15, these through-passage passages 16 can urge a part of the viscous fluid which collects in the radially inner region of the heat generating chamber 8 situated in front of the front end face 15*a* of the rotor element 15 due to the Weisenberg Effect and due to the influence of movement of the gaseous component contained in the viscous fluid, to move through the through-passages 16 from the front side toward the rear side of the rotor element 15. When the part of the viscous fluid is delivered from the through-passages 16 into the rear side of the rear end face 15*b* of the rotor element 15, it can in turn move the viscous fluid held behind the rear end face 15*b* of the rotor element 15 from the radially inner region of the heat generating chamber 8 toward the radially outer region of the heat generating chamber 8 while simultaneously causing the viscous fluid to move from a region behind the rear end face 15*b* of the rotor element 15 toward a region ahead the front end face 15*a* of the rotor element 15 via the small gap between the circumference of the rotor element 15 and the cylindrical inner wall surface of the heat generating chamber 8. Consequently, during the operation of the viscous fluid type heat generator, the viscous fluid can be constantly circulated through the heat generating chamber 8 in response to the rotation of the rotor element 15. Namely, in the viscous fluid type heat generator accommodating therein the rotor element according to the first embodiment, since the viscous fluid within the heat generating chamber 8 can be effectively prevented from stagnating in a fixed region therein, all of the viscous fluid within the heat generating chamber 8 can be equivalently subjected to a shearing action to generate heat. Thus, the physical property of the viscous fluid can be stable for a long life of use without being degraded.

Further, in the described viscous fluid type heat generator, the heat generating chamber 8, particularly, the viscous fluid holding gap between the rear end face 15*b* and the inner wall surface 3*a* of the heat generating chamber 8 fluidly communicates the fluid-storing chamber SR via the fluid withdrawing passage 3*j*, the viscous fluid collected in the central portion of the above-mentioned fluid holding gap due to the Weisenberg Effect and due to the movement of the gaseous component in the chamber 8 can be quickly withdrawn into the fluid storing chamber SR via the fluid withdrawing passage 3*j*. Simultaneously, the viscous fluid in the fluid storing chamber SR can be supplied therefrom into the heat generating chamber 8. Therefore, the viscous fluid can be interchanged between the heat generating chamber 8 and the fluid storing chamber SR via the fluid withdrawing passage formed by the through-hole 3*j* and the fluid supply passage formed by the through-hole 3*k* and the radial fluid supply groove 3*m*, so that the degradation of the viscous fluid may be impeded. Thus, the heat generating performance of the heat generator is maintained at a high level during the long operation life of the heat generator.

Further, the provision of the fluid storing chamber SR for storing a given amount of the viscous fluid which may be adjustably supplied into the heat generating chamber 8 permits the heat generating chamber 8 to be supplied with an optimum amount of viscous fluid in response to an increase or a decrease in the heat generation on the basis of a heat requirement from the external heating system. Moreover, since the fluid storing chamber SR has an open cavity above the fluid level of the viscous fluid stored therein, when the viscous fluid within the heat generating chamber 8 is heated to increase pressure of the gaseous component prevailing in the heat generating chamber 8, the pressurized gaseous component can flow into the open cavity of the fluid storing chamber SR, and accordingly, an excessive pressure does not appear in the heat generating chamber B. Therefore, the shaft sealing device 12 is not subjected to any excessive pressure during the operation of the heat generator. Thus, the shaft sealing function of the shaft sealing device can be constantly maintained stable.

Further, since the fluid storing chamber SR stores the viscous fluid of which the amount is sufficiently larger than the amount of viscous fluid held between the front and rear end faces 15*a* and 15*b* of the rotor element 15 and the inner wall surfaces 2*a* and 3*a* of the heat generating chamber 8, and since the interchanging of the viscous fluid between the heat generating chamber 8 and the fluid storing chamber SR frequently occurs, the viscous fluid to which the shearing force is applied within the heat generating chamber 8 is constantly changed. Namely, such a phenomenon that a specified amount of unchanged viscous fluid is repeatedly subjected to a shearing action to fluid-frictionally generate heat within the heat generating chamber 8 does not occur. As a result, the degradation of the viscous fluid after a short using time of the viscous fluid can be impeded.

Additionally, in the viscous fluid type heat generator provided with the rotor element 15 of the first embodiment, the viscous fluid held on the front side of the rotor element has a constant continuity with the viscous fluid held on the rear side of the rotor element 15 through the obliquely arranged through-passages 16, and accordingly, pressure of the viscous fluid held on the front side of the rotor element 15 is maintained to be equivalent to that of the viscous fluid held on the rear side of the rotor element 15. Therefore, when the rotor element 15 is mounted on the drive shaft 14 by a spline engagement so as to be non-rotatable but axially movable with respect to the drive shaft 14, the rotor element 15 can be axially moved to and held at a position where an equilibrium in pressure on both sides of the rotor element is always established within the heat generating chamber 8 during the operation of the heat generator. Thus, the rotor element 15 does not cause a mechanical interference with the inner wall surfaces 2*a* and 3*a* of the heat generating chamber 8 during the rotation thereof, and can generate a substantially equal amount of heat on both sides of the rotor element 15 by effectively avoiding a reduction in a total amount of heat generation.

Figure 4:
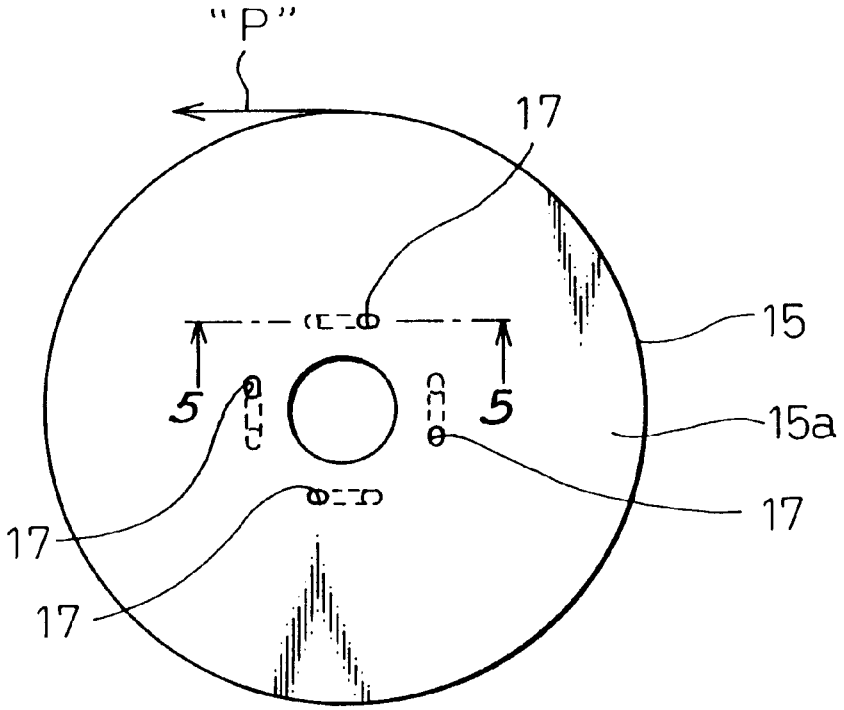
FIG. 4 is a front view of a rotor element according to a second embodiment of the present invention, suitable for being accommodated in the viscous fluid type heat generator of FIG. 1.
Figure 5:
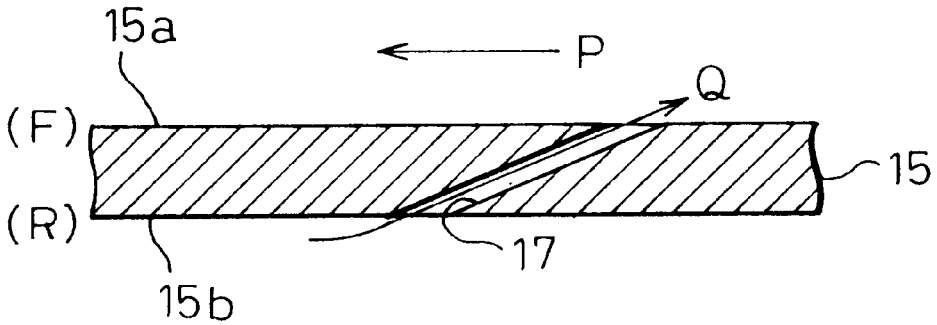
FIG. 5 is a partial and enlarged cross-sectional view of the rotor element, taken along the line B—B of FIG. 4.

Referring to FIGS. 4 and 5 illustrating a rotor element 15 according to a second embodiment, it will be understood that the rotor element 15 of the second embodiment is different from that of the first embodiment in that each of four through-passages 17 of the second embodiment is formed to extend obliquely from the front end face 15*a* to the rear end face 15*b* of the rotor element 15 in the direction "P". Namely, each of the four through-passages 15 has a center line extending along the rotating direction "P" of the rotor element 15 which is tangential to the outer circumference of the rotor element 15, and the four through-passages 17 are equiangularly arranged around the axis of rotation of the rotor element 15. Since each of the through-passages is provided with an open leading end lying in the rear end face 15*b* and an open trailing end lying in the front end face 15*a* of the rotor element 15 with respect to the rotating direction "P", so that the rotation of the rotor element 15 in the direction "P" causes the viscous fluid to move through the through-passages 17 from the rear side to the front side of the rotor element 15 in the direction shown by an arrow "Q". More specifically, when the rotor element 15 is rotated in the direction "P", the viscous fluid held on the rear side of the rotor element 15 enters the four through-passages 17 and is delivered therefrom toward the front side of the rotor element 15 within the heat generating chamber 8. The viscous fluid delivered toward the front side of the rotor element 15 is in turn moved from the front side of the rotor element 15 toward the rear side of the rotor element 15 via the annular gap between the outer circumference of the rotor element 15 and the inner cylindrical wall surface of the heat generating chamber 8. Therefore, within the heat generating chamber 8, the viscous fluid is constantly urged to circulatorily move through the fluid holding gaps between the front and rear end faces 15*a* and 15*b* of the rotor element 15 and the inner wall surfaces 2*a* and 3*a* of the heat generating chamber 8, the above-mentioned annular gap, and the through-passages 17.

Further since the four through-passages 17 are arranged in a radially inner region of the rotor element 15, the viscous fluid collected toward the inner region of the gap between the rear end face 15*b* of the rotor element 15 and the inner wall surface 3*a* of the heat generating chamber 8 due to the Weisenberg Effect and due to the movement of the gaseous component within the heat generating chamber 8 can flow through the through-passages 17 of the rotor element 15 into the radially inner region of the gap between the front end face 15*a* of the rotor element 15 and the inner wall surface 2*a* of the heat generating chamber 8. The viscous fluid is then moved from the radially inner region toward the radially outer region of the gap between the front end face 15*a* of the rotor element 15 and the inner wall surface 2*a* of the heat generating chamber 8, and further toward the rear side of the rotor element 15 via the annular gap between the outer circumference of the rotor element 15 and the cylindrical inner-wall of the heat generating chamber 8. Therefore, the viscous fluid can be generally circulated through the radially inner regions of the gaps between the front and rear end faces 15*a* and 15*b* of the rotor element 15 and the radially outer regions of the same gaps.

Thus, the circulatory movement of the viscous fluid within the heat generating chamber 8 during the operation of the heat generator permits all of the viscous fluid to be equivalently subjected to a shearing action by the rotation of the rotor element 15 to generate heat, and accordingly, all part of the viscous fluid is gradually and equivalently degraded without causing degradation of a limited part of the viscous fluid for a long operation life of the heat generator. The rotor element 15 of the second embodiment can enjoy all of the other advantages similar to those described with respect to the rotor element 15 of the first embodiment.

Figure 6:
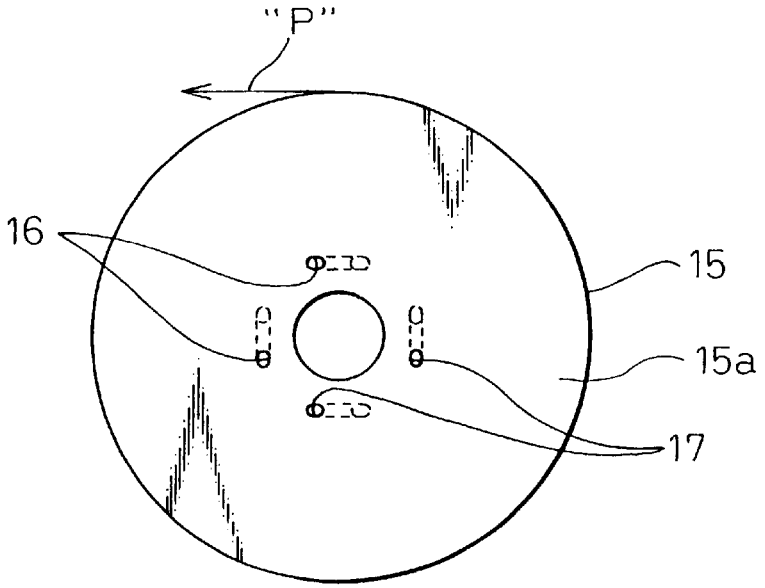
FIG. 6 is a front view of a rotor element according to a third embodiment of the present invention, suitable for being accommodated in the viscous fluid type heat generator of FIG. 1.

Referring to FIG. 6, illustrating a rotor element of the third embodiment suitable for being accommodated in the viscous fluid type heat generator, it should be understood that the rotor element 15 of this embodiment is provided with a pair of obliquely extending through-passages 16 similar to the through-passages 16 of the rotor element of the first embodiment, and a different pair of obliquely extending through-passages 17 similar to the through-passages 17 of the rotor element 15 of the second embodiment. The through-passages 16 are circumferentially arranged side by side, and the through-passages 17 are circumferentially arranged side by side, and the four through-passages 16 and 17 are formed in a radially inner region of the rotor element 15. These four through-passages 16 and 17 contribute to causing a circulatory movement of the viscous fluid through the regions between the front and rear end faces 15*a* and 15*b* of the rotor element 15, the through-passages 16 and 17, and the annular gap between the outer circumference of the rotor element 15 and the cylindrical inner wall surface of the heat generating chamber 8. Therefore, the heat generator including the rotor element 15 of the third embodiment can impede the degradation of the viscous fluid during the long operation life of the heat generator, so that the reliability of the operation of the viscous fluid type heat generator can be increased.

FIGS. 7 through 10 illustrate a rotor element of a fourth embodiment of the present invention, which is definitely different in the construction of through-passages compared with that of rotor element 15 of the previous first through third embodiments.

The rotor element 15 of the fourth embodiment is provided with four radially outer through-passages and four radially inner through-passages which pierce through front and rear end faces 15*a* and 15*b* thereof.

Each of the radially outer through-passages includes a through-bore 19 extending in parallel with the axis of rotation of the rotor element 15. The four through-bores 19 are circumferentially equiangularly arranged, and also equidistantly arranged with respect to the axis of rotation of the rotor element 15.

Each of the radially inner through-passages includes a through-bore 20 extending in parallel with the axis of rotation of the rotor element 15. The four through-bores 20 are circumferentially equiangularly arranged, and also arranged equidistantly with respect to the axis of rotation of the rotor element 15. These through-bores 19 and 20 have a substantial volume therein, respectively, for holding the viscous fluid when the rotor element 15 is assembled in the heat generating chamber 8. Therefore, the through-bores 19 and 20 can act to increase fluid holding gaps between the rotor element 15 and the inner wall surfaces of the heat generating chamber 8 when the rotor element 15 is rotated within the heat generating chamber 8.

Each of the through-bores 19 of the radially outer through-passages is arranged at a position spaced by 0.86 $r_0$ from the axis of rotation, i.e., the center of the rotor element 15 when the radius of the rotor element 15 is $r_0$. The radius of each through-bore 19 corresponds to 0.09 $r_0$.

Each of the through-bores 20 of the radially inner through-passages is arranged at a position spaced by 0.33 $r_0$ from the axis of rotation, i.e., the center of the rotor element 15, and the radius of each through-bore 20 corresponds to 0.06 $r_0$.

The through-bores 19 and 20 have open ends lying in the front and rear end faces 15*a* and 15*b* of the rotor element 15. The open ends of the through-bores 19 and 20 are not rounded and have acute edges 19*a* and 20*a* (see FIG. 8).

Figure 7:
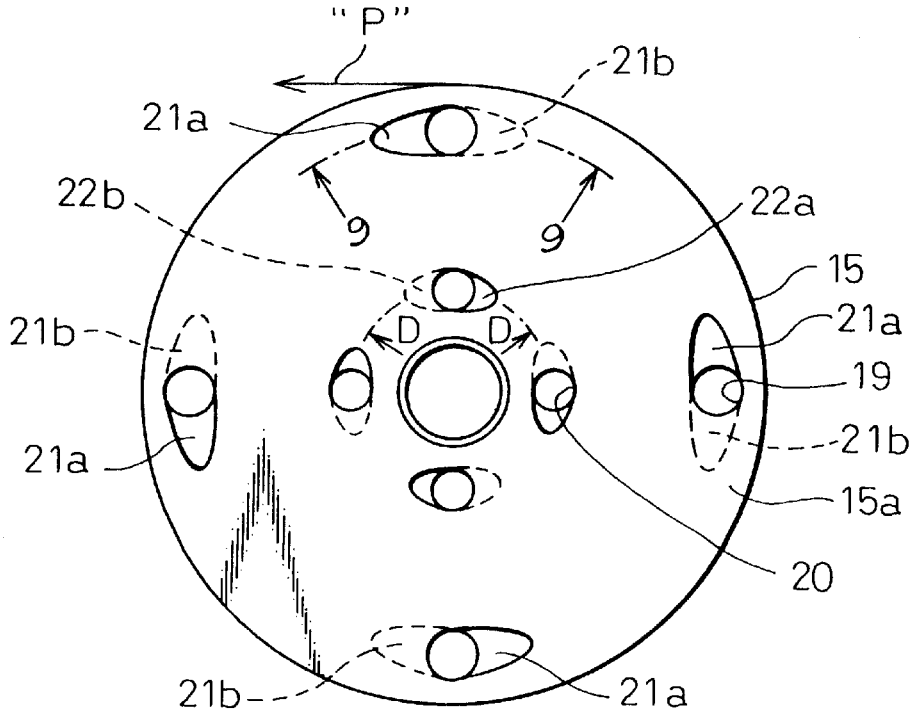
FIG. 7 is an enlarged front view of a rotor element according to a fourth embodiment of the present invention, suitable for being accommodated in the viscous fluid type heat generator of FIG. 1.
Figure 8:
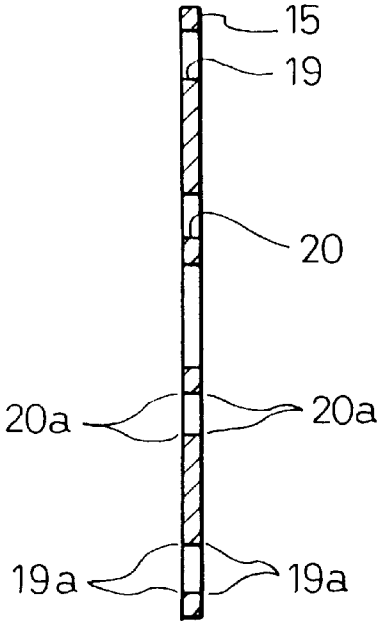
FIG. 8 is a diametrically cross-sectional view of the rotor element of FIG. 7.
Figure 9:
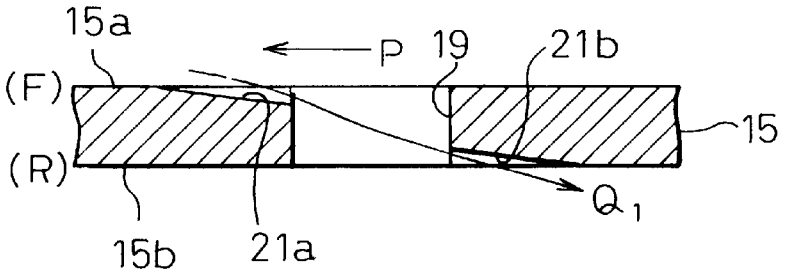
FIG. 9 is a partial and enlarged cross-sectional view of the rotor element of the fourth embodiment, taken along the line C—C of FIG. 7.

As best shown in FIGS. 7 and 9, the radially outer though-passages are further provided with sloping recesses 21*a* formed in the front end face 15*a* of the rotor element 15 to be continuous with respective through-bores 19. Namely, respective sloping recesses 21*a* are formed by machining the front end face 15*a* of the rotor element 15 at a portion of the round edges of the through-bores 19. The respective sloping recesses 21*a* are formed to be circumferentially extended in a direction corresponding to the rotating direction "P" of the rotor element 15, and to ascend from the edges of the respective through-bores 19 toward the front end face 15*a* as shown in FIG. 9. The radially outer though-passages are still further provided with sloping recesses 21*b* formed in the rear end face 15*b* of the rotor element 15 to be continuous with respective through-bores 19. Respective sloping recesses 21*b* are formed by machining the rear end face 15*b* of the rotor element 15 at a portion of the round edges of the through-bores 19. The respective sloping recesses 21*b* are formed to be circumferentially extended in a direction corresponding to the counter-rotating direction of the rotor element 15, and to descend from the edges of the respective through-bores 19 toward the rear end face 15*b* as shown in FIG. 9. That is to say, the sloping recesses 21*b* of the rear end face 15*b* are extended in a direction reverse to the direction in which the sloping recesses 21*a* of the front end face 15*a* of the rotor element 15 extend.

Figure 10:
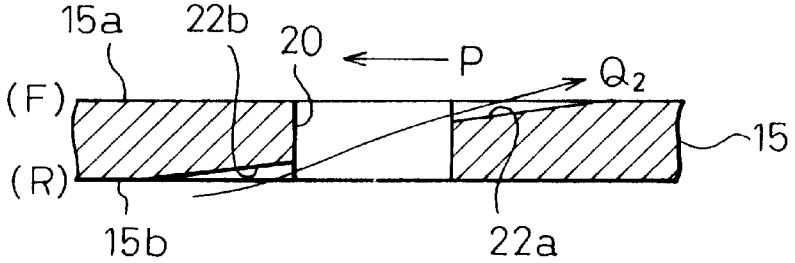
FIG. 10 is a partial and enlarged cross-sectional view of the rotor element of the fourth embodiment, taken along the line D—D of FIG. 7.

As shown in FIGS. 7 and 10, the radially inner though-passages are further provided with sloping recesses 22*a* formed in the front end face 15*a* of the rotor element 15 to be continuous with respective through-bores 20. Namely, respective sloping recesses 22*a* are formed by machining the front end face 15*a* of the rotor element 15 at a portion of the round edges of the through-bores 19. The respective sloping recesses 22*a* are formed to be circumferentially extended in a direction reverse to the rotating direction "P" of the rotor element 15, and to ascend from the edges of the respective through-bores 20 toward the front end face 15*a* as shown in FIG. 10. The radially outer though-passages are still further provided with sloping recesses 22*b* formed in the rear end face 15*b* of the rotor element 15 to be continuous with respective through-bores 20. Respective sloping recesses 22*b* are formed by machining the rear end face 15*b* of the rotor element 15 at a portion of the round edges of the through-bores 20. The respective sloping recesses 22*b* are formed to be circumferentially extended in a direction corresponding to the rotating direction "P" of the rotor element 15, and to descend from the edges of the respective through-bores 20 toward the rear end face 15*b* as shown in FIG. 10. Thus, the sloping recesses 22*b* of the rear end face 15*b* are extended in a direction opposite to the direction in which the sloping recesses 22*a* of the front end face 15*a* of the rotor element 15 extend.

With a viscous fluid type heat generator including therein the rotor element 15 according to the fourth embodiment, when the rotor element 15 is rotated within the heat generating chamber 8, the radially outer through-passages having the through-bores 19 and the sloping recesses 21*a* and 21*b* provide the viscous fluid held between the front end face 15*a* of the rotor element 15 and the inner wall surface 2*a* (see FIG. 1) of the heat generating chamber 8 with a movement designated by an arrow $Q_1$ shown in FIG. 9 by the guidance of the sloping recesses 21*a* and 21*b*, in response to the rotation of the rotor element 15.

On the other hand, when the rotor element 15 is rotated within the heat generating chamber 8, the radially inner through-passages having the through-bores 20 and the sloping recesses 22*a* and 22*b* provide the viscous fluid held between a radially inner region of the front end face 15*a* of the rotor element 15 and the inner wall surface 2*a* of the heat generating chamber 8 with a movement designated by an arrow $Q_2$ shown in FIG. 10 by the guidance of the sloping recesses 22*a* and 22*b*, in response to the rotation of the rotor element 15.

Therefore, in the viscous fluid type heat generator provided with the rotor element 15 of the fourth embodiment, the viscous fluid collected toward the inner region of the fluid holding gap between the rear end face 15*b* of the rotor element 15 and the inner wall surface 3*a* of the heat generating chamber 8 by the Weisenberg Effect and the movement of the gaseous component in the heat generating chamber 8 is urged to move through the radially inner through-passages 20 from the rear side of the rotor element 15 to the front side of the rotor element 15. The viscous fluid is further moved therefrom toward a radially outer region of the fluid holding gap between the front end face 15*a* of the rotor element 15 and the inner wall surfaces 2*a* of the heat generating chamber 8. Thus, the viscous fluid moved toward the radially outer region is then moved toward the fluid holding gap between an outer peripheral portion of the rear end face 15*b* of the rotor element 15 and the inner wall surface 3*a* of the heat generating chamber 8 via the radially outer through-passages having the through-bores 19 and the sloping recesses 21*a* and 21*b* and via the annular gap between the outer circumference of the rotor element 15 and the cylindrical inner wall surface of the heat generating chamber 8. Thus, the viscous fluid within the heat generating chamber 8 is constantly and effectively circulated through the radially inner regions of the fluid holding gaps between the front and rear end faces 15*a* and 15*b* of the rotor element 15, the radially inner and outer through-passages of the rotor element 15, the radially outer regions of the fluid holding gaps between the front and rear end faces 15*a* and 15*b* of the rotor element 15, and the annular gap between the outer circumference of the rotor element 15 and the cylindrical inner wall surface of the heat generating chamber 8. Accordingly, all of the viscous fluid held in the heat generating chamber 8 can be equivalently subjected to a shearing action provided by the rotation of the rotor element 15, and therefore, the degradation in the heat generating property of the viscous fluid can be impeded.

Further, in the viscous fluid type heat generator including the rotor element 15 according to the fourth embodiment, the provision of the sloping recesses 21*b* and 22*b* in the rear end face 15*b* of the rotor element 15 permits an axial and gradual change in a cross sectional area of the fluid holding gap provided between the rear end face 15*b* of the rotor element 15 and the inner wall surface 3*a* of the heat generating chamber 8. Therefore, when the viscous fluid is supplied from the fluid storing chamber SR into the heat generating chamber 8 via the fluid supplying passage including through-hole 3*k* and the fluid supplying groove 3*m* (FIG. 1), the viscous fluid can smoothly flow into the heat generating chamber 8. Thus, the interchanging of the viscous fluid between the heat generating chamber 8 and the fluid storing chamber SR is smoothly and efficiently carried out to result in impeding the degradation in the heat generating property of the viscous fluid.

When the rotor element 15 according to the fourth embodiment is employed, the viscous fluid is moved from the fluid holding gap between the front end face 15*a* and the inner wall surface 2*a* of the heat generating chamber 8 to the fluid holding gap between the rear end face 15*b* and the inner wall surface 3*a* of the heat generating chamber 8 and vice versa, via the through-bores 19 of the radially outer through-passage and the through-bores 20 of the radially inner through-passage during the operation of the heat generator in response to the rotation of the rotor element 15. Accordingly, the pressures of the viscous fluid prevailing in the above-mentioned two fluid holding gaps are constantly maintained at an equilibrium state. Therefore, even when the rotor element 15 is mounted on the drive shaft 14 by a spline engagement so as to be axially movable but rotationally fixed with respect to the drive shaft 14, the rotor element 15 is moved to a position where the pressure of the viscous fluid acting on the front and rear end faces 15*a* and 15*b* of the rotor element 15 is in equilibrium. Consequently, the rotor element 15 does not cause a mechanical interference with the inner wall surfaces of the heat generating chamber 8. Further, as an equal amount of the viscous fluid is always held on both sides of the rotor element 15, an effective heat generation can be achieved by the viscous fluid within the heat generating chamber 8.

In the viscous fluid type heat generator including the rotor element 15 according to the fourth embodiment, the through-bores 19 arranged equiangularly in the outer peripheral portion of the rotor element 15 and the through-bores 20 arranged equiangularly in the radially inner portion of the rotor element 15 act so as to hold therein the viscous fluid. This means that the provision of the through-bores 19 and 20 causes a cyclic change in the size of the fluid holding gaps between the front and rear end faces 15*a* and 15*b* of the rotor element 15 and the inner wall surfaces 2*a* and 3*a* of the heat generating chamber 8 in the circumferential direction around the axis of rotation of the rotor element 15. Accordingly, when the rotor element 15 is rotated about its axis of rotation, the sizes of the fluid holding gaps are increased compared with the rotor element having no through-bores therein. Thus, the viscous fluid having a chain molecular structure therein and confined within the fluid holding gaps in the heat generating chamber 8 is subjected to a larger constraint when the rotor element 15 rotates. Accordingly, the viscous fluid makes resistance against movement caused by the rotating rotor element 15, and therefore, a larger shearing force is applied to the vacuous fluid to generate a larger amount of heat.

Specifically, when it is considered that the peripheral portion of the rotor element 15 has a circumferential speed larger than that of the radially inner portion of the rotor element to be effective for producing a large frictional torque, the through-bores 19 formed in the peripheral portion of the rotor element 15 are very effective for applying a larger shearing force to the viscous fluid. Accordingly, a heat generating efficiency of the heat generator including the rotor element according to the fourth embodiment can be very large.

Further, the through-bores 19 and 20 of the rotor element 15 can trap the gaseous component contained in the viscous fluid held between the front and rear end faces 15*a* and 15*b* and the inner wall surfaces of the heat generating chamber 8 during the operation of the heat generator, and accordingly, the viscous fluid held between the front and rear end faces 15*a* and 15*b* except for the portions of the through-bores 19 and 20, and the sloping recesses 21*a* and 22*a* and the inner wall surfaces 2*a* and 3*a* of the heat generating chamber 8 does not contain the gaseous component therein. Therefore, a shearing force is efficiently applied to the viscous fluid by the rotating rotor element 15, so that very effective heat generation can be achieved.

Furthermore, since the through-bores 19 and 20 of the rotor element 15 are provided with acute edges 19*a* and 20*a*, when the rotor element 15 is rotated, these acute edges 19*a* and 20*a* apply an increased amount of constraint to the viscous fluid when the viscous fluid is moved by the rotating rotor element 15. Accordingly, the viscous fluid can be subjected to a large shearing force to result in efficiently generating heat to be used for heating an objective heated area.

During the operation of the heat generator, the through-bores 19 and 20 of the rotor element 15 can hold the afore-mentioned trapped gaseous component therein. This is also effective for increasing a shearing force applied to the viscous fluid.

Although the provision of the through-bores 19 and 20 and the sloping recesses 21*a*, 21*b*, 22*a* and 22*b* in the front and rear end faces 15*a* and 15*b* of the rotor element may reduce a heat generating region obtained between the rotor element 15 and the inner wall surfaces of the heat generating chamber 8, the above-mentioned increase in the shearing force applied to the viscous fluid due to the provision of the through-bores 19 and 20 and the sloping recesses 21*a*, 21*b*, 22*a* and 22*b* in the front and rear end faces 15*a* and 15*b* contributes to an effective heat generation by the viscous fluid, and generates an increased amount of heat used for heating the objective heated area.

Further, when the viscous fluid type heat generator is stopped, the viscous fluid within the heat generating chamber 8 drops in a bottom portion of the heat generating chamber 8. At this stage, since the through-bores 19 are arranged in the outer peripheral portion of the rotor element 15 of the fourth embodiment, these through-bores 19 of the rotor element 15 can act to carry the viscous fluid from the bottom portion of the heat generating chamber 8 toward an upper portion of the heat generating chamber 8 due to the rotation of the rotor element 15. Thus, at the initial stage of the operation of the heat generator, the viscous fluid can be quickly distributed to all portions of the fluid holding and heat generating gaps between the rotor element 15 and the inner wall surfaces of the heat generating chamber 8. Accordingly, the viscous fluid type heat generator including the rotor element of the fourth embodiment can quickly start the heat generating operation.

Further, the viscous fluid type heat generator including the rotor element 15 according to the fourth embodiment is provided with the fluid storing chamber SR in the rear housing body for storing a given amount of the viscous fluid to be interchanged with the viscous fluid held in the fluid holding gaps between the rotor element 15 and the inner wall surfaces of the heat generating chamber. Therefore, when the heat generator is stopped, a large amount of gaseous component is confined in a radially upper region of the fluid holding gaps within the heat generating chamber 8. This confined gaseous component urges the viscous fluid in the heat generating chamber 8 to move downward due to gravity acting on the fluid until it is held in the bottom of the heat generating chamber 8 during the stopping of operation of the heat generator. Therefore, the through-bores 19 and 20 can be effective for carrying the reserved viscous fluid and distributing it to all portions of the fluid holding and heat generating gaps within the heat generating chamber when the rotor element of the heat generator starts to rotate.

Although the afore-mentioned viscous fluid type heat generator including one of the rotor elements according to the first through fourth embodiments of the present invention is provided with the fluid storing chamber SR formed in the rear housing body, the rotor elements according to the first through fourth embodiments may equally applicable to a variable heat generation viscous fluid type heat generator in which a control valve is provided for controlling a supply of viscous fluid from a fluid storing chamber to a heat generating chamber by regulating the opening and closing of the fluid withdrawing passage and the fluid supplying passage, and to a viscous fluid type heat generator having no auxiliary chamber such as a fluid storing chamber.

It should be understood from the foregoing description of the preferred embodiments that the viscous fluid type heat generator accommodating therein a rotor element according to various embodiments of the present invention can effectively impede degradation of the viscous fluid filled therein to thereby guarantee a long reliable operating life of the heat generator.

Many modifications and variations will occur to persons skilled in the art without departing from the spirit and scope of the present invention claimed in the accompanying claims.

What we claim is:

1. A viscous fluid type heat generator fluid-frictionally generating heat by the application of a shearing force to a viscous fluid, comprising:

a housing assembly;

a fluid-tight heat generating chamber defined in said housing assembly and receiving the viscous fluid filed therein, said fluid-tight heat generating chamber having inner wall surfaces thereof;

a heat receiving chamber arranged adjacent to said fluid-tight heat generating chamber and permitting a heat exchanging fluid to circulate therethrough to thereby receive heat from said fluid-tight heat generating chamber;

a drive shaft supported by said housing assembly to be rotatable about an axis of rotation thereof; and a rotor element arranged in said heat generating chamber to be rotationally driven by said drive shaft for rotation about an axis of rotation thereof relative to said heat generating chamber, wherein said rotor element is provided with outer surfaces arranged to extend substantially perpendicularly to the axis of rotation of said rotor element and confronting said inner wall surfaces of said fluid-tight heat generating chamber to define predetermined gaps on both sides of said outer surfaces thereof, said rotor element being further provided with at least one through-passage bored through said outer surfaces thereof to have a fluid guide permitting the viscous fluid within said heat generating chamber to move through said through-passage in response to the rotation of said rotor element, said through-passage of said rotor element being formed as a through-bore having a center line obliquely extending from one of said outer surfaces of said rotor element to the other surface thereof and an oblique bore wall functioning as said fluid guide.

2. A viscous fluid type heat generator according to claim 1, wherein said center line of said through-bore is arranged to extend along the rotating direction of said rotor element.

3. A viscous fluid type heat generator according to claim 2, wherein said rotor element is provided with a plurality of through-passages arranged circumferentially and equidistantly around the axis of rotation of said rotor element, each of said plurality of through-passages being formed as said through-bore obliquely pierces said outer surfaces of said rotor element.

4. A viscous fluid type heat generator according to claim 1, wherein said through-passage of said rotor element is arranged in at least one of radially inner and outer regions of said rotor element with respect to the axis of rotation thereof.

5. A viscous fluid type heat generator according to claim 1, wherein said through-passage of said rotor element includes at least one through-bore piercing said outer surfaces of said rotor element, and at least one sloping recess formed in one of the opposite ends of said through-bore so as to extend in one of two directions corresponding to the rotating and counter-rotating directions of said rotor element.

6. A viscous fluid type heat generator according to claim 5, wherein said through-bore and said sloping recess of said through-passage of said rotor element are arranged in at least one of the radially inner and outer regions with respect to the axis of rotation of the rotor element.

7. A viscous fluid type heat generator according to claim 6, wherein said radially inner and outer regions of the rotor element are bounded by a circle having a radius of 0.33 $r_0$ with respect to the axis of rotation of said rotor element of which a radius is defined as "$r_0$".

8. A viscous fluid type heat generator according to claim 5, wherein said opposite ends of said through-bore are not rounded and have an acute edge to apply a resistance to the movement of the viscous fluid during the rotation of said rotor element within said heat generating chamber, whereby the application of the resistance to the movement of the viscous fluid results in applying a stronger shearing force to the viscous fluid to thereby increase heat generation by said viscous fluid.

9. A viscous fluid type heat generator according to claim 1, wherein said through-passage of said rotor element includes a pair of sloping recesses formed in the opposite ends of said through-bore of said rotor element, one of said pair of sloping recesses extending in a direction corresponding to the rotating direction of said rotor element, and the other of said pair of sloping recesses extending in a direction corresponding to the counter-rotating direction of said rotor element.

10. A viscous fluid type heat generator according to claim 1, further comprising a fluid storing chamber formed in said housing assembly for storing a given amount of viscous fluid, said fluid storing chamber communicating with said heat generating chamber via a fluid withdrawing passage through which the viscous fluid is withdrawn from said heat generating chamber to said fluid storing chamber and via a fluid supplying passage through which the viscous fluid is supplied from said fluid storing chamber to said heat generating chamber.

11. A viscous fluid type heat generator according to claim 10, wherein said predetermined gaps on both sides of said outer surfaces of said rotor element are communicated with one another via an annular gap provided between an outer circumference of said rotor element and a confronting annular inner wall surface of said heat generating chamber, so that the viscous fluid is permitted to make a circulatory movement from said fluid storing chamber through said predetermined gaps on both sides of said rotor element.

12. A viscous fluid type heat generator fluid-frictionally generating a heat by the application of a shearing force to a viscous fluid, comprising:

a housing assembly;

a fluid-tight heat generating chamber defined in said housing assembly and receiving the viscous fluid filled therein, said fluid-tight heat generating chamber having inner wall surfaces thereof;

a heat receiving chamber arranged adjacent to said fluid-tight heat generating chamber and permitting a heat exchanging fluid to circulate therethrough to thereby receive heat from said fluid-tight heat generating chamber;

a drive shaft supported by said housing assembly to be rotatable about an axis of rotation thereof; and a rotor element arranged in said heat generating chamber to be rotationally driven by said drive shaft for rotation about an axis of rotation thereof relative to said heat generating chamber, wherein said rotor element is provided with axially front and rear outer surfaces confronting said inner wall surfaces of said heat generating chamber to define predetermined fluid holding gaps therebetween, said rotor element being further provided with at least one through-passage bored through said front and rear outer surfaces of said rotor element, said through-passage extending obliquely with respect to said front and rear outer surfaces of said rotor element and having a central line in a direction corresponding to the rotating direction of said rotor element to permit the viscous fluid within said heat generating chamber to move through said through-passage in response to the rotation of said rotor element.

13. A viscous fluid type heat generator according to claim 12, wherein said obliquely extending through-passage of said rotor element is formed to descend from said rear outer surface toward said front outer surface of said rotor element, with respect to the rotating direction of said rotor element, so that the viscous fluid is moved from said predetermined fluid holding gap between said front outer surface of said rotor element and said inner wall surface of said heat generating chamber toward said predetermined fluid holding gap between said rear outer surface of said rotor element and said inner wall surface of said heat generating chamber in response to the rotation of said rotor element.

14. A viscous fluid type heat generator according to claim 12, wherein said obliquely extending through-passage of said rotor element is formed to descend from said front outer surface toward said rear outer surface of said rotor element, with respect to the rotating direction of said rotor element, so that the viscous fluid is moved from said predetermined fluid holding gap between said rear outer surface of said rotor element and said inner wall surface of said heat generating chamber toward said predetermined fluid holding gap between said front outer surface of said rotor element and said inner wall surface of said heat generating chamber in response to the rotation of said rotor element.

15. A viscous fluid type heat generator according to claim 12, further comprising a fluid storing chamber for storing a given amount of viscous fluid, said fluid storing chamber communicating with said heat generating chamber via a fluid withdrawing passage through which the viscous fluid is withdrawn from said heat generating chamber to said fluid storing chamber and via a fluid supplying passage through which the viscous fluid is supplied from said fluid storing chamber to said heat generating chamber.

16. A viscous fluid type heat generator according to claim 15, wherein said predetermined fluid holding gaps on both sides of said outer surfaces of said rotor element are communicated with one another via an annular gap provided between an outer circumference of said rotor element and a confronting cylindrical inner wall surface of said heat generating chamber, so that the viscous fluid is permitted to make a circulatory movement from said fluid storing chamber through said predetermined fluid holding gaps on both sided of said rotor element.

* * * * *